US007416416B1

(12) United States Patent
Hsu

(10) Patent No.: US 7,416,416 B1
(45) Date of Patent: Aug. 26, 2008

(54) HIGH FREQUENCY CONNECTOR

(75) Inventor: Chin-Teng Hsu, Yungkang (TW)

(73) Assignee: Lih Yeu Seng Industries Co., Ltd., Yungkang (TW)

( * ) Notice: Subject to any disclaimer, the term of this patent is extended or adjusted under 35 U.S.C. 154(b) by 0 days.

(21) Appl. No.: 11/692,017

(22) Filed: Mar. 27, 2007

(51) Int. Cl.
*H01R 12/00* (2006.01)

(52) U.S. Cl. ..... 439/63

(58) Field of Classification Search ..... 439/63, 439/578, 581, 582, 585; 174/87 C
See application file for complete search history.

(56) References Cited

U.S. PATENT DOCUMENTS 3,480,722 A * 11/1969 Horssen et al. ..... 174/87
3,528,052 A * 9/1970 Brishka ..... 439/582
5,494,454 A * 2/1996 Johnsen ..... 439/394
7,025,599 B1 * 4/2006 Wang ..... 439/63

* cited by examiner

*Primary Examiner*—Alexander Gilman
(74) *Attorney, Agent, or Firm*—Alan Kamrath; Kamrath & Associates PA

(57) ABSTRACT

A high frequency connector includes a first module and a second module for signal transmission. The two modules are easily manufactured and assembled. The disclosed high frequency connector can maneuverably connect with the connector thereof according to the required direction of signal transmission so that competent transmissive connection is achieved when the two modules are assembled and thus preventing generation of noise. The volume of each of the two modules is precisely designed so that the high frequency connector facilitates reduction in power loss when being implemented for the purpose of signal transmission.

14 Claims, 9 Drawing Sheets

HIGH FREQUENCY CONNECTOR

BACKGROUND OF THE INVENTION

1. Technical Field

The present invention relates to high frequency connectors and, more particularly, to a high frequency connector comprising two modules that can be easily manufactured and promptly assembled. The two modules of the disclosed high frequency connector can maneuverably connect with each other according to a required direction of signal transmission, so that a competent transmissive connection can be achieved when the two modules are assembled, and thus preventing generation of noise. The volume of each of the modules is precisely designed so that the high frequency connector facilitates reduction in power loss when being implemented for the purpose of signal transmission.

2. Description of Related Art

A presently developed high frequency connector for the purpose of signal transmission is typically constructed by assembling a first module 10 and a second module 20 (referring to FIGS. 1 through 3). The first module 10 (referring to FIG. 1) comprises a connecting element 101 having a through hole 102 at a predetermined position thereon for receiving a hollow connecting tube 103. The connecting tube 103 has a threaded section 104 formed at the outer periphery thereof. The connecting element 101 and the connecting tube 103 are fastened together by making the connecting peripheries welded or wedged. The second module 20 (referring to FIG. 2) comprises a connecting element 201 having a through hole 202 at a predetermined position thereon for receiving a hollow connecting tube 203. Similarly, the connecting element 201 and the connecting tube 203 are fastened together by making the connecting peripheries welded or wedged. To combine the two modules 10 and 20, referring to FIGS. 3 and 3A, a C-shaped retaining ring 205 is coupled with an annular groove 2041 on the combining section 204 extending from the second module 20. Further, a needle 206 jutting out from the second module 20 is received by a recess of a needle 105 inserted at the corresponding end of the first module 10 so that insulators 106 therein can be connected mutually. After the two modules 10, 20 are assembled for the purpose of signal transmission, the needles 105, 206 therein get connected mutually. At this time, the line contact between the two modules is liable to have intermittent interruptions due to external forces, which consequently leads to signal interference resulting in the generation of noise. Further, since the C-shaped retaining ring 205 assembled on the second module 20 is of a flat form, it is liable to have elastic fatigue after a period of use. Consequently, the combination between the two modules 10, 20 may become loosened and fail to bear relatively higher torsion force.

SUMMARY OF THE INVENTION

The present invention has been accomplished under these circumstances in view to ameliorate a conventional high frequency connector for signal transmission by improved combination of the modules, so that the stability of signal transmission can be enhanced and generation of noise can be efficiently eliminated. Also, connectors can maneuverably connect with each other according to a required direction of signal transmission so that the integrated connectors can have a precise volume after components are assembled.

It is one objective of the present invention to provide a high frequency connector, which is constructed by assembling a first module and a second module mutually. The first module comprises a connecting element having a through hole for receiving an insulator and having a gap formed at one side of the through hole. An L-shaped needle is inserted into a through hole of the insulator and an upper section of the L-shaped needle further extends in a horizontal segment of the connector. Two insulators are respectively arranged at a bent portion of the L-shaped needle between the connecting element and the connector, and the horizontal segment of the connector. The first module constructed as described above may further comprise a plurality of legs extending from the connecting element downward. By the gap at the side of the connecting element, the connecting element can be attached by the connector along a straight direction (i.e. 180°) or with an angle of 90°.

It is another objective of the present invention to provide a high frequency connector, which is constructed by assembling a first module and a second module mutually. The second module comprises a connecting element having a through hole formed at one side thereof and can be locked with a connector by screwing. The connector has a relatively larger accommodating space for receiving an insulator and the insulator permits a needle to pass through. An effective end of the needle pierces through the connecting element and juts out of the connecting element into a relatively smaller through hole. Additionally, the needle has another end near the connector contacting an insulator. Further, a positioning element is locked with a fabricating hole by screwing. Moreover, a connector is fastened to the connecting element at one end where the needle protrudes. An outer end of the smaller through hole of the connecting element forms a chamfered section. The chamfered section permits an enlarged sectional area so that the air retained therein as well as the air retained in a vacant space of the through hole can function as insulation during signal transmission. Also, the chamfered section balances impedance errors that may be caused by different diameters of the needles of the first and second modules when the two modules are mutually engaged.

It is another objective of the present invention to provide a high frequency connector that is constructed by assembling a first module and a second module mutually. A C-shaped retaining ring is coupled with an annular groove of a connecting element of the second module and has an effective end outwardly warped for facilitating the combination between the connecting element and a connector. Thereby, the assembled components can be firmly fastened and effectively protected from loosening or coming off when an external pulling or dragging force is applied.

It is another objective of the present invention to provide a high frequency connector, which is constructed by assembling a first module and a second module. A connector, which is to be locked with a connecting element by screwing for converting the extension direction into an angle of 90°, may have a connecting end and a converting end formed integrally so that the construction and manufacture of the connector can be simplified.

It is yet another objective of the present invention to provide a high frequency connector, which is constructed by assembling a first module and a second module. The second module comprises a connecting element having a larger accommodating space for receiving an insulator. The insulator passes through a needle therein and has one end being formed integrally with or separately from a spacer having an indentation. By the spacer having the indentation, air isolation can be achieved between the indentation and the needle so as to balance impedance errors occurring at an interface between the needle and an extended antenna or coaxial cable adjacent to a through hole.

It is still another objective of the present invention to provide a high frequency connector, which is constructed by assembling a first module and a second module. A needle jutting out from the second module and a needle settled in the first module are partially connected, and the two modules are spaced with an interval. In virtue of the interval, line contact between the two modules can be free from intermittent interruptions so that generation of noise is efficiently prevented.

BRIEF DESCRIPTION OF THE DRAWINGS

The invention as well as a preferred mode of use, further objectives and advantages thereof, will be best understood by reference to the following detailed description of an illustrative embodiment when read in conjunction with the accompanying drawings, wherein.

DETAILED DESCRIPTION OF THE PREFERRED EMBODIMENT

Figure 8:
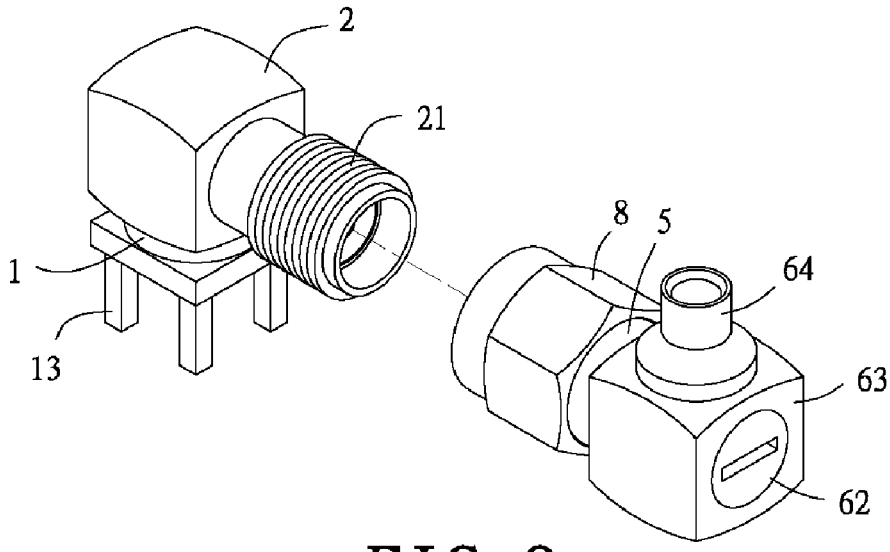
FIG. 8 is a perspective view showing the first and second modules before connection.
Figure 9:
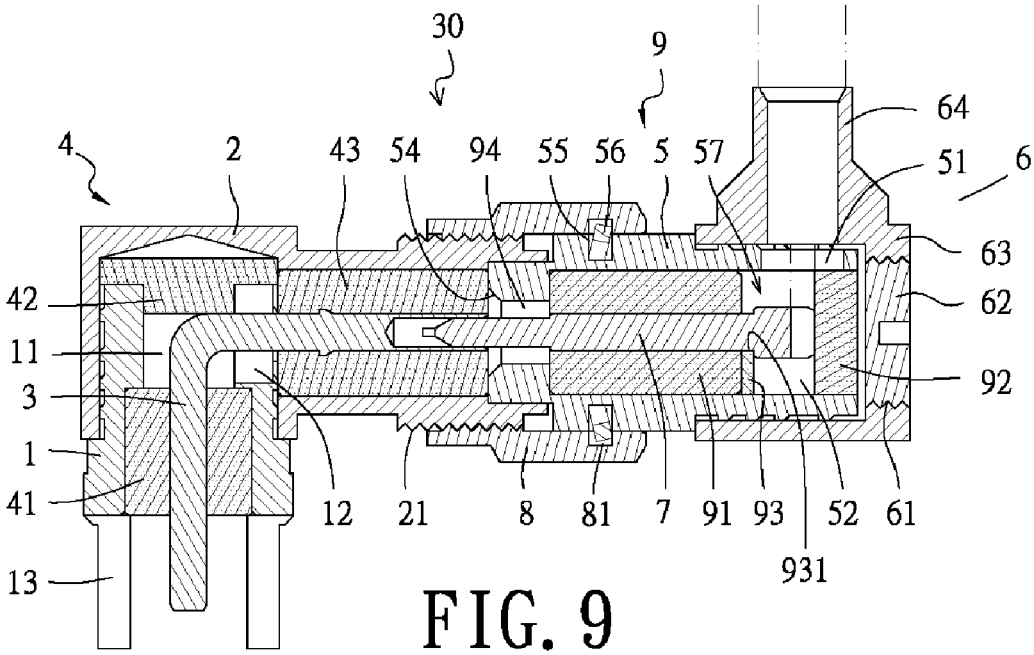
FIG. 9 is a cross sectional view showing the first and second modules after connection.

Referring to FIGS. 8 and 9, a high frequency connector of the present invention comprises a first module 4 and a second module 9.

Figure 1:
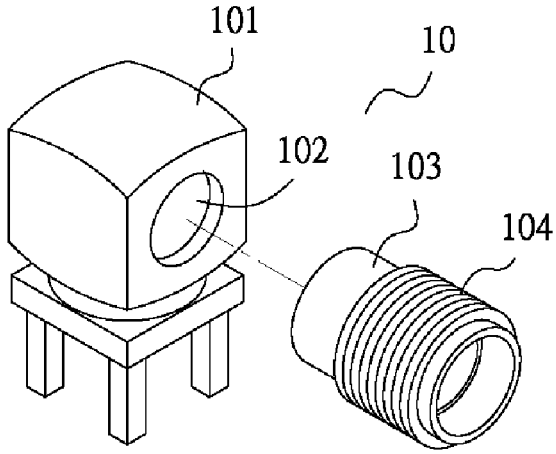
FIG. 1 (Prior Art)
FIG. 1 is an exploded perspective view of a first module of a conventional high frequency connector.
Figure 2:
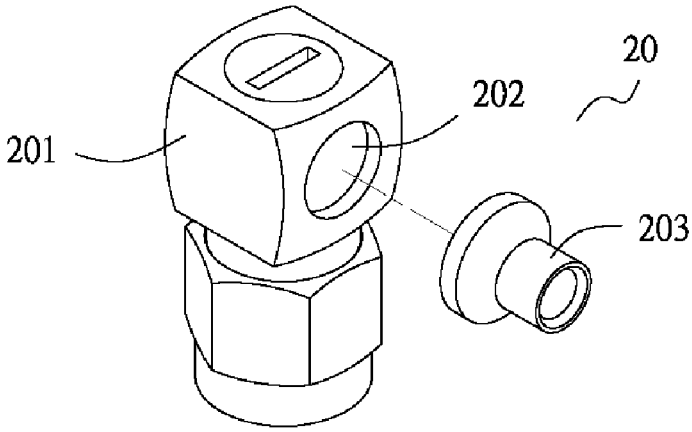
FIG. 2 (Prior Art)
FIG. 2 is an exploded perspective view of a second module of the conventional high frequency connector.
Figure 3:
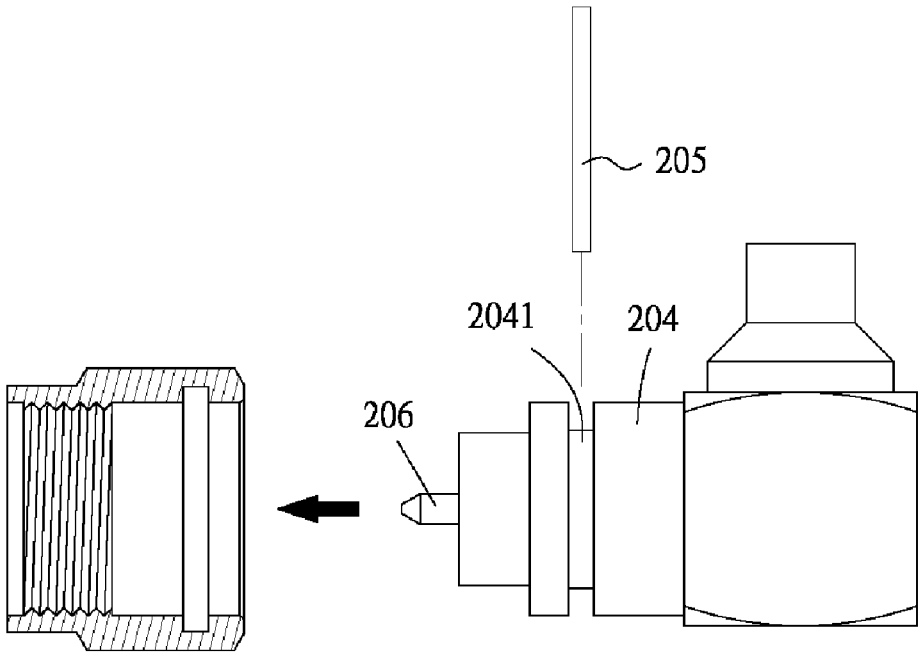
FIG. 3 (Prior Art)
FIG. 3 is a schematic drawing showing the two modules of the conventional high frequency connector getting assembled.
Figure 3A:
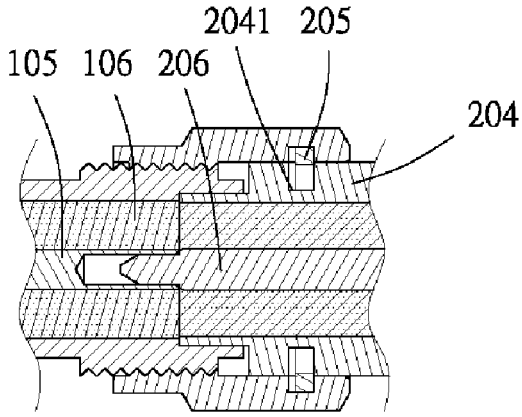
FIG. 3A (Prior Art)
FIG. 3A is a cross sectional view of two assembled modules of the conventional high frequency connectors.
Figure 4:
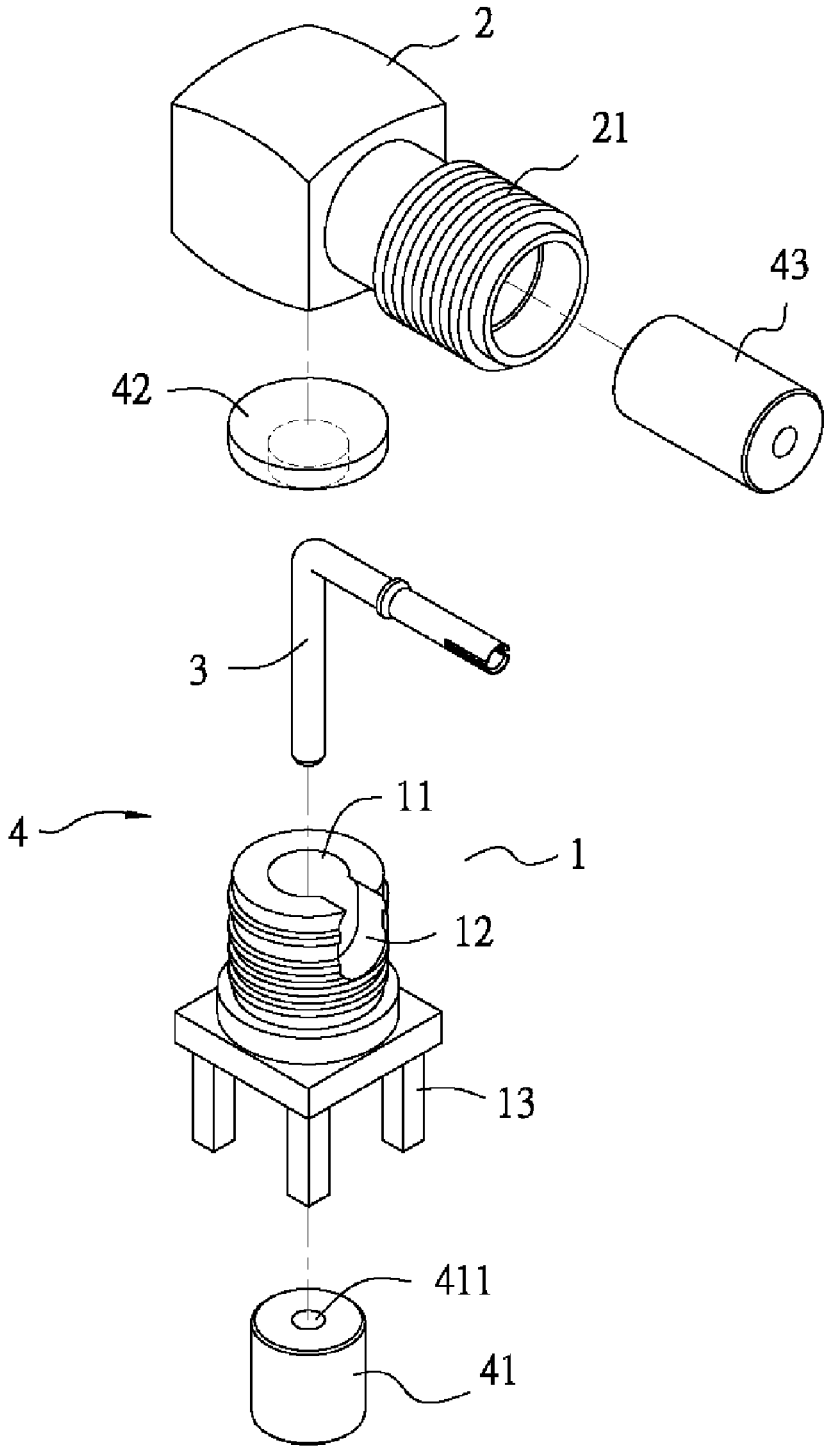
FIG. 4 is an exploded perspective view of a first module of a high frequency connector of the present invention.
Figure 5:
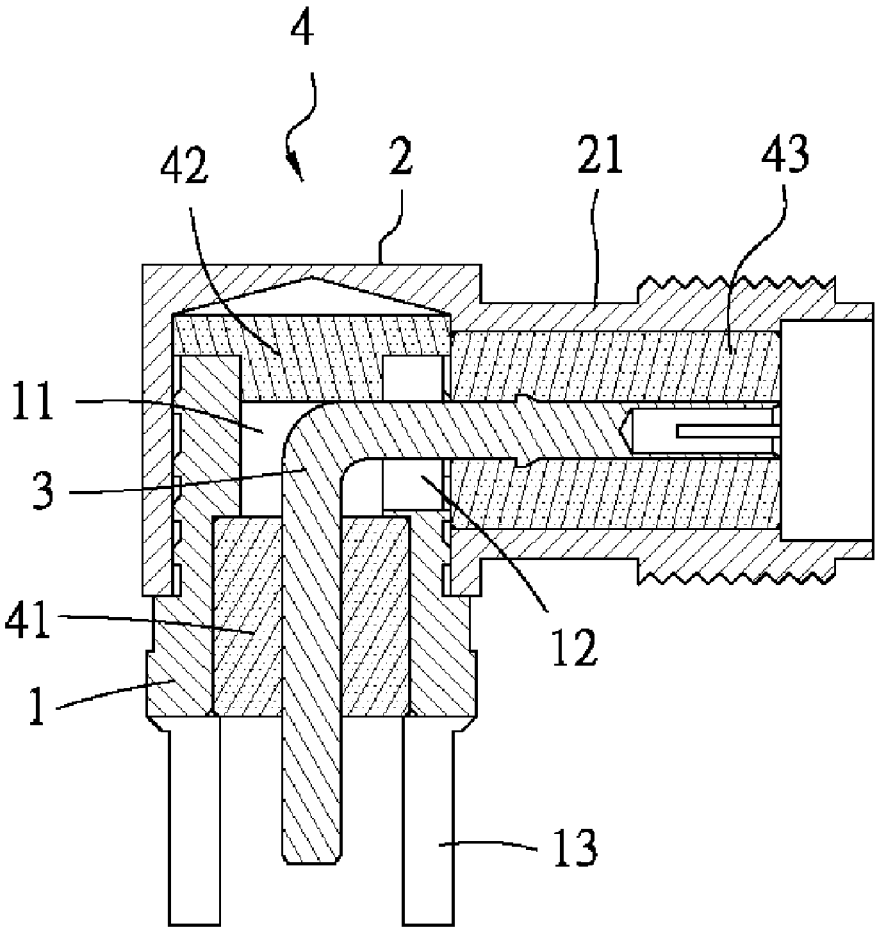
FIG. 5 is a cross sectional view showing the assembled first module of the high frequency connector of the present invention.

The first module 4 (referring to FIGS. 4 and 5) comprises a connecting element 1 having a through hole 11 for receiving an insulator 41, and having a gap 12 formed at one side. By this gap 12, the mating length between the connecting element 1 and a connector 2 can be enhanced. An L-shaped needle 3 can be inserted into a through hole 411 of the insulator 41 while extending into a 90° angle to penetrate a horizontal segment 21 of the connector 2 so that a relative rotation between the connecting element 1 and the connector 2 is restricted. A positioning insulator 42 is settled between the connecting element 1 and the connector 2 at the bent portion of the L-shaped needle 3, while an insulator 43 is inserted into the horizontal segment 21. The positioning insulator 42 herein functions for eliminating impedance errors. The first module 4 constructed as above may further comprise a plurality of legs 13 extending downward from the connecting element 1 or extending sideways from the connector 2 and, in either case, by the gap 12 at the side of the connecting element 1, the connecting element 1 can be attached by the connector along a straight direction (i.e. 180°) or with an angle of 90°. (Hereinafter the connecting element 1 having the plural legs 13 extending downward is taken as an exemplificative embodiment).

The second module 9 (referring to FIGS. 6 and 7) comprises a connecting element 5 that has a through hole 51 formed at one side thereof and can be locked with a connector 6 by screwing. By this through hole 51, the mating length between the connecting element 5 and the connector 6 can be enhanced. Relative rotation between the connecting element 5 and the connector 6 is restricted. An insulator 91 is inserted into a relatively larger accommodating space 52 and receives a needle 7 that penetrates through. An effective end of the needle 7 pierces through the connecting element 5 and juts out from a relatively smaller through hole 53. Additionally, the needle 7 has the end near the connector 6 contacting with an insulator 92. Then, a positioning element 62 is locked with a fabricating hole 61 of the connector 6 by screwing. Moreover, a connector 8 is fastened to the connecting element 5 at the end where the needle 7 protrudes. The second module 9, constructed as above, further comprises a chamfered section 54 formed on an outer end of the relatively smaller through hole 53 of the connecting element 5. The chamfered section 54 permits an enlarged sectional area so that the air retained therein as well as the air retained in the vacant space of the through hole 53 can function as insulation during signal transmission. Also, the chamfered section 54 balances impedance errors that may be caused by different diameters of the needles of the first and second modules 4 and 9 when the two modules 4 and 9 are mutually engaged.

For assembling the connecting element 5 with the connector 8 of the second module 9, referring to FIGS. 7, 7A, 7B and 7C, a C-shaped retaining ring 56 which has an effective end warped outwardly is wedged into an annular groove 55 of the connecting element 5. Since the wedged C-shaped retaining ring 56 would contract toward the center of the annular groove 55, a force would act inwardly and the C-shaped retaining ring 56 can be easily guided toward and positioned in a positioning groove 81 of the connector 8 (referring to FIG. 7B). Thus, when an external force pulls the C-shaped retaining ring 56 outward from the annular groove 55, which results in a force acting outwardly to make the C-shaped retaining ring 56 depart from the connecting element 5, but the positioning groove 81 of the connector 8 can efficiently retain the C-shaped retaining ring 56 from separating (referring to FIG. 7C). Thereby, the components can be firmly and effectively protected from loosening and coming off when an external pulling or dragging force is applied.

Figure 6:
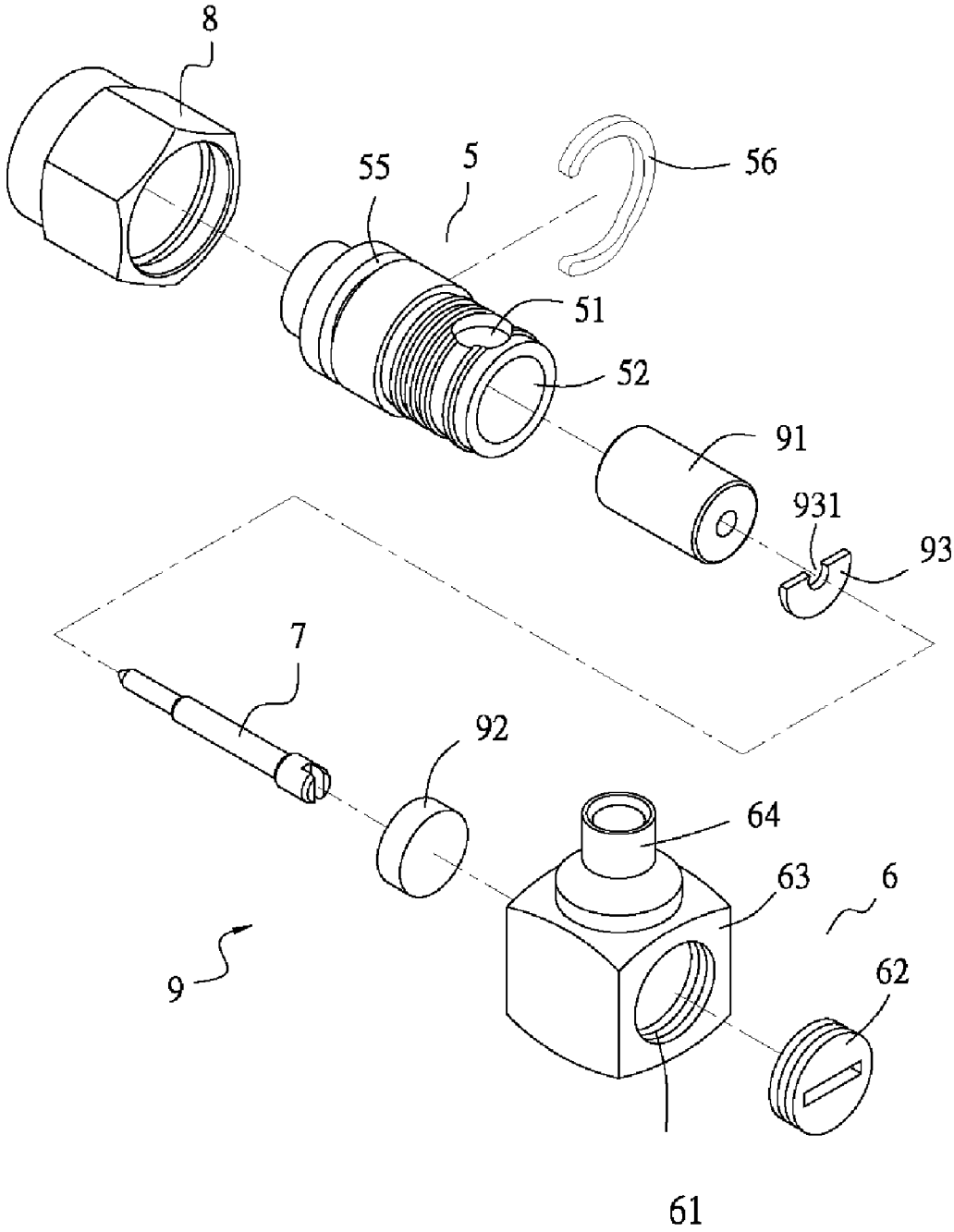
FIG. 6 is an exploded perspective view of a second module of the high frequency connector of the present invention.
Figure 7:
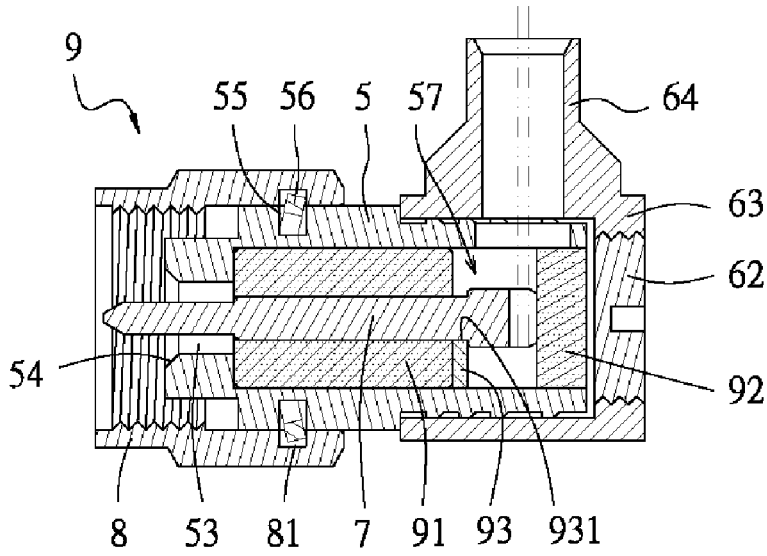
FIG. 7 is a cross sectional view showing the assembled second module of the high frequency connector of the present invention.
Figure 7A:
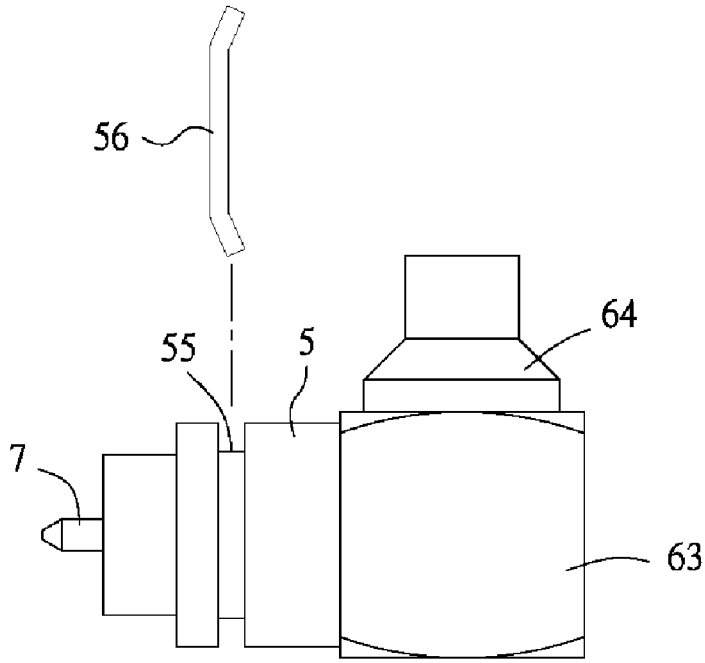
FIG. 7A is a lateral view showing the second module without a C-shaped retaining ring being assembled to a connecting element.
Figure 7B:
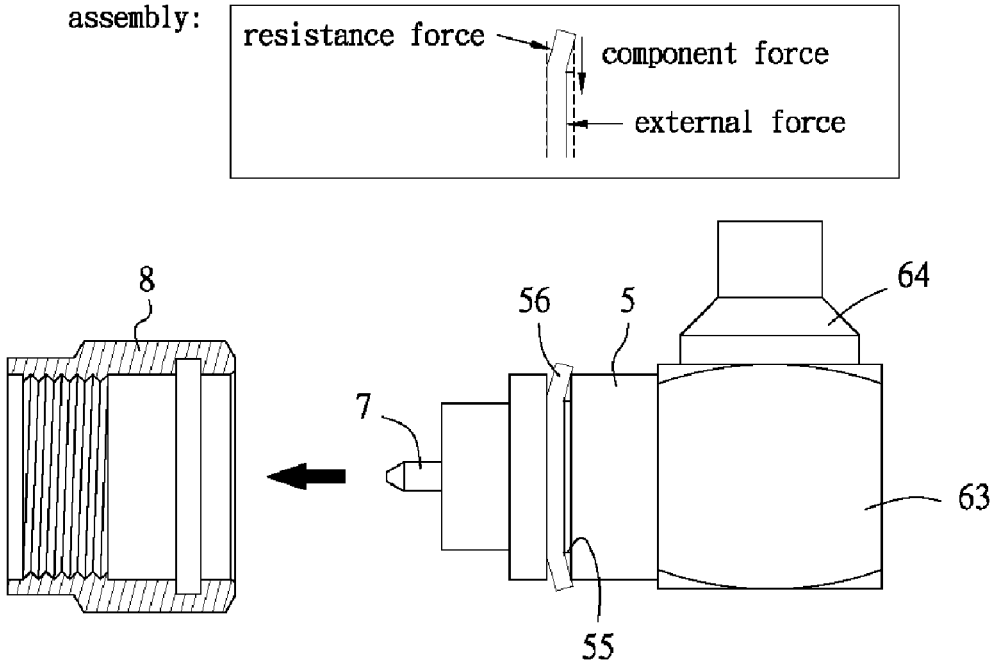
FIG. 7B is a lateral view showing the second module with the C-shaped retaining ring being assembled to the connecting element.
Figure 7C:
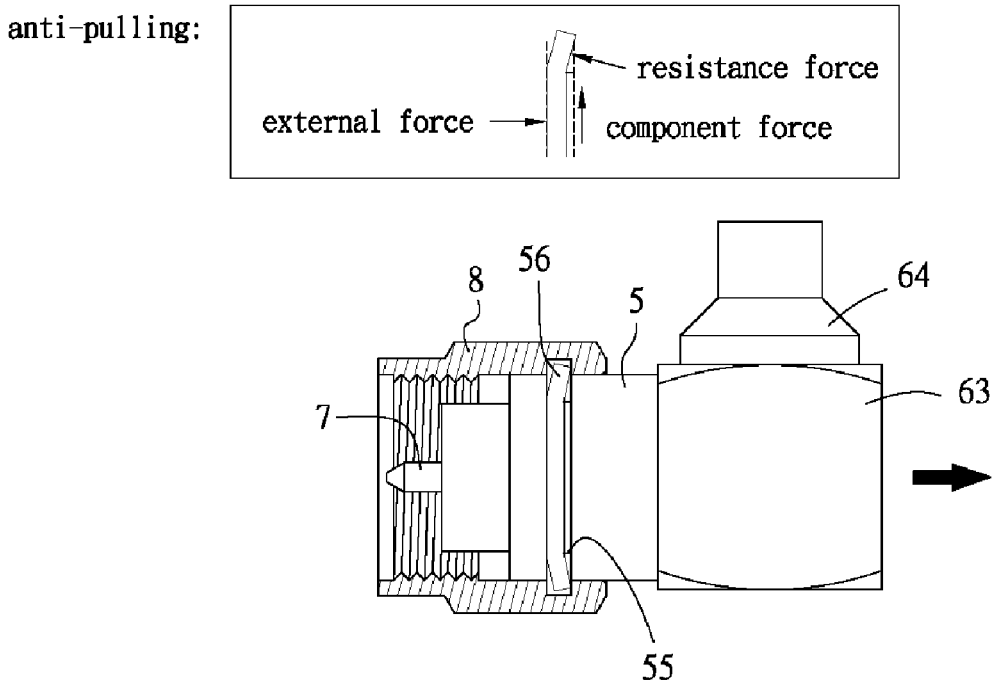
FIG. 7C is a lateral view showing the counteractive between the C-shaped retaining ring and the connecting element.

The connector 6, which is to be locked with the connecting element 5 by screwing for converting the extension direction into an angle of 90°, has a connecting end 63 and a converting end 64 that may be integrally formed (as shown in FIG. 6) so that construction and manufacturing of the connector 6 can be simplified.

The insulator 91 of the second module 9, which is inserted into the relatively larger accommodating space 52 of the connecting element 5 and receives the needle 7, pierced through, may be formed integrally with or separately from a spacer 93 that has an indentation 931 (referring to FIG. 6). The spacer 93 having the indentation 931 balances the impedance errors occurring at a connecting portion 57 of the needle 7 (i.e. the section where the needle 7 contacts with an extended antenna or coaxial cable adjacent to the through hole 51). The indentation 931 may be sized according to the diameter of the antenna or cable it contacts.

When the first and second modules 4 and 9 are assembled to construct a high frequency connector 30, the needle 7 jutting out from the second module 9 and the needle 3 settled in the first module 4 are partially connected (referring to FIG. 9), and the two modules 4 and 9 are spaced with an interval 94. In virtue of the interval 94, line contact between the two modules 4 and 9 can be free from intermittent interruptions so that the generation of noise can be efficiently prevented.

Figure 10:
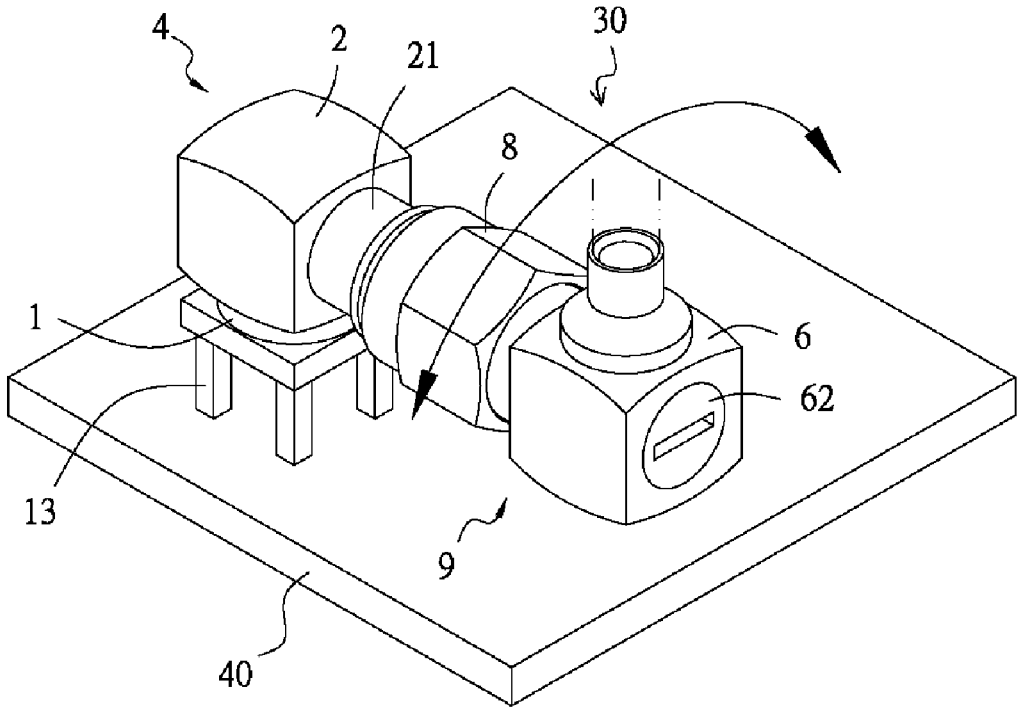
FIG. 10 is an illustrative view showing that after the high frequency connector is fixed on a board, the second module can be maneuverably rotated.

Referring to FIG. 10, the high frequency connector 30 composed of the first module 4 and the second module 9 is applied to a board 40 for the purpose of signal transmission. The legs 13 of the connecting element 1 of the first module 4 are fastened at predetermined locations on the board 40, whereby the connector 6 of the second module 9 can be turned to a desired direction according to the required direction of a connecting module (referring to the arrow in FIG. 10 showing the rotating direction). Hence, the high frequency connector 30 has practical adaptability and maneuverability.

The disclosed high frequency connector 30 constructed by assembling the first and second modules 4 and 9 has the following advantages:

1. The gap formed at the side of the connecting element 1 of the first module 4 facilitates enhancement of the mating length and restriction of the relative rotation between the connecting element 1 and the connector 2. Also, the connecting element 1 can be attached by the connector 2 at a 180° angle (straight direction) or with an angle of 90° as required.

2. The chamfered section 54 formed at the end of the connecting element 5 of the second module 9 permits an enlarged sectional area, so that the air retained therein as well as the air retained in the vacant space of the through hole 51 can function as insulation during signal transmission. Further, the chamfered section 54 balances impedance errors that may be caused by the different diameters of the needles 3 and 7 of the first and second modules 4 and 9 when the two modules 4 and 9 are mutually engaged.

3. The C-shaped retaining ring 56 settled in the annular groove 55 of the connecting element 5 of the second module 9 has the effective end outwardly warped for facilitating the combination between the connecting element 5 and the connector 8. Thereby, the assembled components can be firmly positioned and effectively protected from loosening or coming off when an external pulling or dragging force is applied.

4. In the disclosed high frequency connector 30, the needle 7 jutting out from the second module 9 and the needle 3 settled in the first module 4 are partially connected and the two modules 4 and 9 are spaced with an interval. In virtue of the interval, line contact between the two modules 4 and 9 can be free from intermittent interrupts so that the generation of noise can be efficiently prevented.

5. The connector 6, which is to be locked with the connecting element 5 by screwing for converting the extension direction into an angle of 90°, has the connecting end 63 and the converting end 64 formed integrally so that the construction and manufacture of the connector 6 can be simplified.

6. The insulator of the second module 9, which is inserted into the relatively larger accommodating space 52 of the connecting element 5 and receives the needle 7, pierced through, is formed integrally with or separately from the spacer 93 that has the indentation 931. The spacer having the indentation balances the impedance errors occurring at the connecting portion 57 of the needle 7 (i.e. the place where the needle 7 contacts with an extended antenna or coaxial cable adjacent to the through hole 51). The indentation 931 may be sized according to the diameter of the antenna or cable it contacts.

7. In the high frequency connector 30 constructed by assembling the first and second modules 4 and 9, the second module 9 can have the direction changed according to the required direction of a connecting module, so that the high frequency connector 30 has practical adaptability and maneuverability.

Although a particular embodiment of the invention has been described in detail for purposes of illustration, it will be understood by one of ordinary skill in the art that numerous variations will be possible to the disclosed embodiments without going outside the scope of the invention as disclosed in the claims.

What is claimed is:

1. A high frequency connector comprising:

a first module and a second module connectable to the first module, wherein the first module comprises:

a connecting element having a through hole, a first module insulator received in the through hole, a connector having a first passageway and a second passageway intersecting the first passageway, with the connector having a connector insulator inserted in the connector through the first passageway, a first, L-shaped needle having first and second sections perpendicular to each other, a gap formed at one side of the connecting element, with the first section of the first, L-shaped needle inserted into the connecting element through the gap, with the second section of the first, L-shaped needle extending through the first module insulator received in the through hole, and a positioning insulator having first and second portions, wherein the first portion is larger than the through hole and the second portion is smaller than the through hole, with the second portion received in the through hole, with the first portion abutting with the connecting element outside the through hole when the second portion is received in the through hole, with the connecting element received in the second passageway of the connector, with the second portion sandwiched between the connecting element and the connector within the second passageway, with the second portion of the positioning insulator abutting and securing the first section of the first, L-shaped needle, wherein the positioning insulator balances impedance errors resulting from a shape of the first, L-shaped needle, wherein a mating length between the connecting element and the connector is enhanced and relative rotation between the connecting element and the connector is restricted.

2. The high frequency connector of claim 1, wherein the second module comprises:

a second module connector having a positioning groove;

a second module connecting element received by the second module connector, with the second module connecting element having an annular groove; and a C-shaped retaining ring wedged in the annular groove of the second module connecting element of the second module, wherein the C-shaped retaining ring has an effective end outwardly warped facilitating a combination between the second module connecting element and the second module connector, with the C-shaped retaining ring received in the positioning groove when the second module connecting element is received by the second module connector, with the second module connector and second module connecting element firmly positioned and protected from loosening and coming off when an external pulling force is applied, and torsion force is increased, with the connector of the first module received in the second module connector when the first and second modules are connected.

3. The high frequency connector of claim 1, wherein the first passageway has first and second ends spaced from and opposite each other, with the second passageway spaced from and intermediate to the first and second ends of the first passageway, with the first end being closed and the second end being open.

4. The high frequency connector of claim 3, wherein the first portion of the positioning insulator is slideably received in the first passageway, with the first portion extending past the second passageway when the first portion of the positioning insulator is slideably received in the first passageway, with the first portion of the positioning insulator sandwiched between the first end of the first passageway and the connecting element when the connecting element is received in the first passageway of the connector.

5. The high frequency connector of claim 1, wherein the second module comprises:

a second module connector;

a second module connecting element having a second module connecting through hole formed at one side of the second module connecting element;

a second module insulator having a second module insulator through hole, with the second module insulator received in the second module connecting element;

a second needle having a first, effective end including a connecting portion provided on the first, effective end of the second needle, with the second needle received in the second module insulator through hole, with the first, effective end of the second needle jutting into the second module connecting through hole and adapted for contacting one of an extended antenna and a coaxial cable when the second needle is received in the second module insulator through hole;

a spacer abutting the second module connecting element and the second module insulator, with the spacer having a spacer indentation, with the second needle received in and abutting with the spacer indentation when the second needle is in the second module insulator through hole, with the spacer intermediate the second module insulator and the connecting portion, with the spacer formed of a material providing balancing of the impedance errors, wherein the spacer indentation is adapted to be sized according to a diameter of the one of the extended antenna and the coaxial cable for balancing the impedance errors occurring at an interface where the second needle contacts with the one of the extended antenna and the coaxial cable;

a relatively smaller through hole with an outer end formed at one end of the second module connecting element, wherein a second end of the second needle juts out from the second module connecting element when the second needle is received in the second module insulator through hole, wherein the second module connector is fastened to the one end of the second module connecting element adjacent to the second end of the second needle; and a chamfered section formed on the outer end of the relatively smaller through hole of the second module connecting element balancing the impedance errors caused by different diameters of the second needle of the second module and the first, L-shaped needle of the first module when the first and second modules are connected, with the connector of the first module received in the second module connector and the second needle of the second module connected to the first, L-shaped needle when the first and second modules are connected.

6. The high frequency connector of claim 5 further having an accommodating space insulator and a positioning element adjustable towards the insulator with the insulator through hole, with the accommodating space insulator intermediate the positioning element and the first, effective end of the second needle, wherein the first, effective end of the second needle has a first needle circumference and the second end of the second needle has a second needle circumference, with the first needle circumference being greater than the second needle circumference, wherein the first, effective end of the second needle abuts the spacer and the insulator with the insulator through hole abuts the spacer opposite to the first, effective end of the second needle sandwiching the spacer in position between the first, effective end of the second needle and the insulator with the insulator through hole, wherein the first, effective end of the second needle holds the spacer against the insulator with the insulator through hole, with the first, effective end of the second needle sandwiched between the spacer and the accommodating space insulator, with the spacer being held tighter against the insulator with the insulator through hole when the positioning element is adjusted further towards the insulator with the insulator through hole and the accommodating space insulator is pushed against the first, effective end of the second needle.

7. The high frequency connector of claim 5, wherein the second module comprises:

a positioning groove located on the second module connector;

an annular groove located on the second module connecting element; and a C-shaped retaining ring wedged in the annular groove of the second module connecting element of the second module, wherein the C-shaped retaining ring has an effective end outwardly warped facilitating a combination between the second module connecting element and the second module connector, with the C-shaped retaining ring received in the positioning groove when the second module connecting element is received by the second module connector, with the second module connector and second module connecting element firmly positioned and protected from loosening and coming off when an external pulling force is applied, and torsion force is increased.

8. The high frequency connector of claim 7 further having an accommodating space insulator and a positioning element adjustable towards the insulator with the insulator through hole, with the accommodating space insulator intermediate the positioning element and the first, effective end of the second needle, wherein the first, effective end of the second needle has a first needle circumference and the second end of the second needle has a second needle circumference, with the first needle circumference being greater than the second needle circumference, wherein the first, effective end of the second needle abuts the spacer and the insulator with the insulator through hole abuts the spacer opposite to the first, effective end of the second needle sandwiching the spacer in position between the first, effective end of the second needle and the insulator with the insulator through hole, wherein the first, effective end of the second needle holds the spacer against the insulator with the insulator through hole, with the first, effective end of the second needle sandwiched between the spacer and the accommodating space insulator, with the spacer being held tighter against the insulator with the insulator through hole when the positioning element is adjusted further towards the insulator with the insulator through hole and the accommodating space insulator is pushed against the first, effective end of the second needle.

9. A high frequency connector comprising:

a first module; and a second module connectable to the first module, wherein the second module comprises:

a connector, a connecting element having a connecting through hole formed at one side of the connecting element, an insulator having an insulator through hole, with the insulator received in the connecting element, a needle having a first, effective end including a connecting portion provided on the first, effective end of the needle, with the needle received in the insulator through hole, with the first, effective end of the needle jutting into the connecting through hole and adapted for contacting one of an extended antenna and a coaxial cable when the needle is received in the insulator through hole, a spacer abutting the connecting element and the insulator, with the spacer having a spacer indentation, with the needle received in and abutting with the spacer indentation when the needle is in the insulator through hole, with the spacer intermediate the insulator and the connecting portion, with the spacer formed of a material providing balancing of impedance errors, wherein the spacer indentation is adapted to be sized according to a diameter of the one of the extended antenna and the coaxial cable for balancing the impedance errors occurring at an interface where the needle contacts with the one of the extended antenna and the coaxial cable, a relatively smaller through hole with an outer end formed at one end of the connecting element, wherein a second end of the needle juts out from the connecting element when the needle is received in the insulator through hole, wherein the connector is fastened to the one end of the connecting element adjacent to the second end of the needle, and a chamfered section formed on the outer end of the relatively smaller through hole of the connecting element balancing the impedance errors caused by different diameters of the needle of the second module when the first and second modules are connected.

10. The high frequency connector of claim 9, wherein the connecting element of the second module further comprises a larger accommodating space receiving the insulator.

11. The high frequency connector of claim 9 further having an accommodating space insulator and a positioning element adjustable towards the insulator with the insulator through hole, with the accommodating space insulator intermediate the positioning element and the first, effective end of the needle, wherein the first, effective end of the needle has a first needle circumference and the second end of the needle has a second needle circumference, with the first needle circumference being greater than the second needle circumference, wherein the first, effective end of the needle abuts the spacer and the insulator with the insulator through hole abuts the spacer opposite to the first, effective end of the needle sandwiching the spacer in position between the first, effective end of the needle and the insulator with the insulator through hole, wherein the first, effective end of the needle holds the spacer against the insulator with the insulator through hole, with the first, effective end of the needle sandwiched between the spacer and the accommodating space insulator, with the spacer being held tighter against the insulator with the insulator through hole when the positioning element is adjusted further towards the insulator with the insulator through hole and the accommodating space insulator is pushed against the first, effective end of the needle.

12. The high frequency connector of claim 9, wherein the second module further comprises:

a positioning groove located on the connector, with the connecting element received by the connector;

an annular groove located on the connecting element;

a C-shaped retaining ring wedged in the annular groove of the connecting element of the second module, wherein the C-shaped retaining ring has an effective end outwardly warped facilitating a combination between the connecting element and the connector, with the C-shaped retaining ring received in the positioning groove when the connecting element is received by the connector, with the connector and connecting element firmly positioned and protected from loosening and coming off when an external pulling force is applied, and torsion force is increased.

13. The high frequency connector of claim 12 further having an accommodating space insulator and a positioning element adjustable towards the insulator with the insulator through hole, with the accommodating space insulator intermediate the positioning element and the first, effective end of the needle, wherein the first, effective end of the needle has a first needle circumference and the second end of the needle has a second needle circumference, with the first needle circumference being greater than the second needle circumference, wherein the first, effective end of the needle abuts the spacer and the insulator with the insulator through hole abuts the spacer opposite to the first, effective end of the needle sandwiching the spacer in position between the first, effective end of the needle and the insulator with the insulator through hole, wherein the first, effective end of the needle holds the spacer against the insulator with the insulator through hole, with the first, effective end of the needle sandwiched between the spacer and the accommodating space insulator, with the spacer being held tighter against the insulator with the insulator through hole when the positioning element is adjusted further towards the insulator with the insulator through hole and the accommodating space insulator is pushed against the first, effective end of the needle.

14. A high frequency connector comprising:

a first module; and a second module connectable to the first module, wherein the second module comprises:

a connector having a positioning groove, a connecting element received by the connector, with the connecting element having an annular groove, and a C-shaped retaining ring wedged in the annular groove of the connecting element of the second module, wherein the C-shaped retaining ring has an effective end outwardly warped facilitating a combination between the connecting element and the connector, with the C-shaped retaining ring received in the positioning groove when the connecting element is received by the connector, with the connector and connecting element firmly positioned and protected from loosening and coming off when an external pulling force is applied, and torsion force is increased.

* * * * *